United States Patent [19]

Johansson

[11] 4,355,768

[45] Oct. 26, 1982

[54] ROTARY GRINDING DISC FOR DEFIBRATING APPARATUS

[75] Inventor: Johan G. I. Johansson, Falkvägen, Sweden

[73] Assignee: Defibrator Aktiebolag, Stockholm, Sweden

[21] Appl. No.: 254,650

[22] Filed: Apr. 16, 1981

Related U.S. Application Data

[62] Division of Ser. No. 16,320, Feb. 28, 1979, Pat. No. 4,274,602.

[30] Foreign Application Priority Data

Mar. 3, 1978 [SE] Sweden ..... 7802471

[51] Int. Cl.[3] ..... B02C 7/04

[52] U.S. Cl. ..... 241/261.3; 241/298; 241/300

[58] Field of Search ..... 241/261.2, 261.3, 296, 241/298, 299, 300

[56] References Cited

U.S. PATENT DOCUMENTS

| | | | |
|---|---|---|---|
| 1,160,964 | 11/1915 | Warren | 241/296 X |
| 2,964,250 | 7/1953 | Astlund | 241/259.2 |
| 4,005,827 | 2/1977 | Frair et al. | 241/298 X |
| 4,157,669 | 6/1979 | Pilâo | 241/298 X |

*Primary Examiner*—Mark Rosenbaum
*Assistant Examiner*—Timothy V. Eley
*Attorney, Agent, or Firm*—Eric Y. Munson

[57] ABSTRACT

A rotary grinding disc in an apparatus for refining fibrous pulp material, comprising a plurality of arcuate grinding plate segments disposed annularly about the disc and supported thereon by means of wedge-shaped tongues projecting from the segment plates and dovetailed into grooves of corresponding profile in the disc, the wedge-shaped tongues and dovetail grooves decreasing in width from an outer radial portion toward an inner radial portion, or vice versa, for wedging the plate segment into the disc. The plate segments may be additionally secured against disc placement by the effect of the centrifugal force during rotation of the disc by means of a peripheral ring surrounding the disc and engaging the wedged tongues.

2 Claims, 7 Drawing Figures

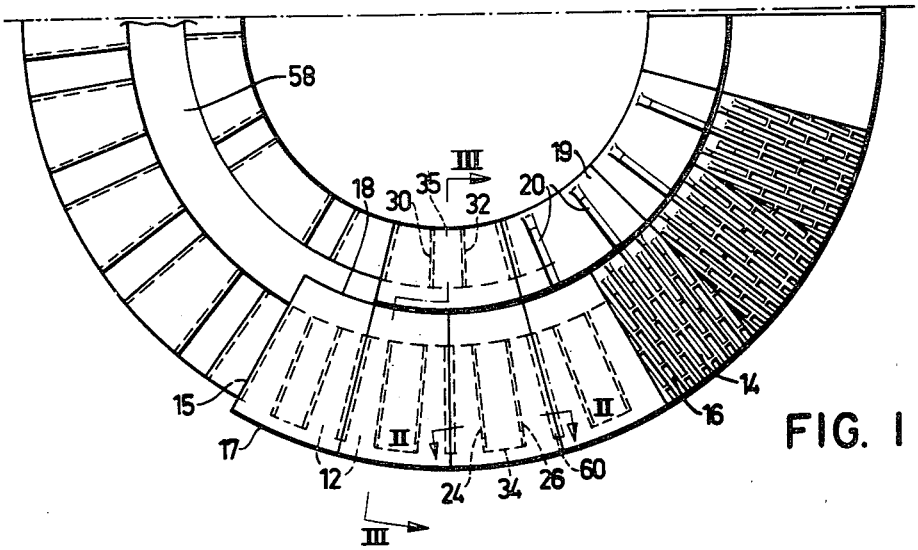
FIG. 1
FIG. 4
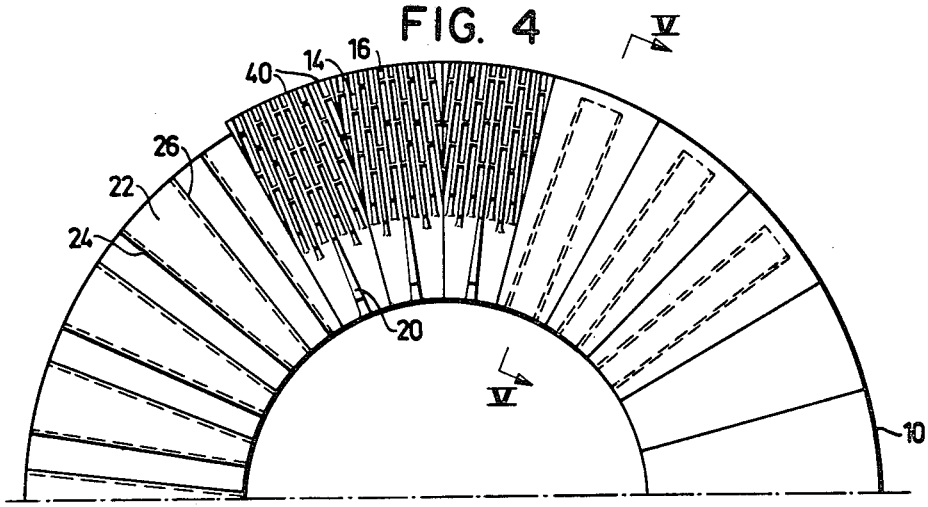

ROTARY GRINDING DISC FOR DEFIBRATING APPARATUS

This is a division, of application Ser. No. 016,320 filed Feb. 28, 1979, now U.S. Pat. No. 4,274,602.

BACKGROUND OF THE INVENTION

The present invention is concerned with a beating element for grinding apparatus for fibrous, preferably vegetable material, which element comprising a supporting component and, attached thereto, at least one ring of segment plates of some hard material which form the grinding surface of the element. In a design commonly met with, such beating elements are given the form of a disc with the segment plates mounted in one or more concentric rings on the radial face of the disc-shaped supporting element. The grinding apparatus is equipped with at least two grinding discs held under pressure the one against the other and mutually rotatable, the feed stock, such as wood chips, being finely divided in the gap between the discs. This gap is defined by the grinding plates. The surface of these plates, which face each other, carries a relief pattern of ribs and ridges, or similar raised surface, to facilitate the process of beating or defibrating the material and separating its fibres and fibrils. In modern beating equipment, the grinding disc rotates at high speed and, furthermore, its diameter is large, and consequently the centrifugal force acting on the plates is extremely strong. By way of illustration it may be noted that in plates weighing only some few tens of kilograms, centrifugal forces in the region of 50 tons may occur.

Hitherto the grinding plates have been secured to the disc-shaped supporting element or grinding-disc holder by bolting, the bolts being screwed into the plates from behind. Since a very high degree of stress has to be reckoned with, several bolts are used for attaching each plate, but in spite of this the stress occurring in the plate itself remains so great that the plates must be designed to a thickness, and therefore to a weight, far in excess of what is actually required for the provision of surface ribs and ridges. In addition, in order to render the plates as resistant as possible to wear, they must be made of extremely hard material, the strength of which is not easily estimated in design calculation. In other words, the design size of the plates is far too large, and therefore the stress to which they and the bolts attaching them to the disc are subjected is increased still further; and because of the great thickness of the plates the centrifugal force to which they are exposed also develops strong torque around their outer circumference and strives to hurl the plates outwards from the supporting disc.

SUMMARY OF THE INVENTION

The purpose of the invention is to replace the system of securing the segment plates by bolts, which has hitherto reigned supreme, by a design in which the stresses occurring in the plates, and particularly those caused by centrifugal force, are better distributed. A further aim is to achieve a type of joint for securing the plates to the supporting disc allowing a considerable reduction in plate thickness, and consequently lighter weight. This is substantially achieved by providing the adjacent surfaces of the plates and supporting disc with wedge-shaped interlocking tongues and grooves so designed as to wedge or lock each plate into the supporting disc with no play between the two. By providing such tongues and grooves, the surfaces which transmit the centrifugal forces from the plates to the supporting disc can be made much larger than if bolts were used, thus giving far better distribution of stress across the plate sections in their entirety. Consequently, the part of the plate behind the ribbed surface can be made considerably thinner than hitherto, which, in turn, helps to lessen the effect of the centrifugal forces, and therefore the stresses arising in the surfaces transmitting these forces are reduced as well. Another advantage of using this method is that the grooves forming the ribs and ridges on the surface of the plates can be made deeper, and therefore the length of time for which the plates may be used will be greater, for the length of the period before the plates are worn down to such an extent that they need replacing is largely dependent on the height of their ribs and ridges.

Apparatus for the defibration and refining of vegetable material to which this invention can be applied may, for instance, be dsigned as described in Swedish Patent Nos. 179 336 which corresponds to U.S. Pat. No. 2,964,250.

BRIEF DESCRIPTION OF THE DRAWINGS

In the following paragraphs, the invention will be described in greater detail with reference to embodiments shown in the attached drawings by way of example. .

FIG. 1 shows a projection of the lower half of a supporting disc on which are mounted grinding plates in one embodiment of the invention.

FIG. 4 shows the upper half of FIG. 1, the grinding plates here being given an alternative design;

DETAILED DESCRIPTION OF PREFERRED EMBODIMENTS

Figure 2:
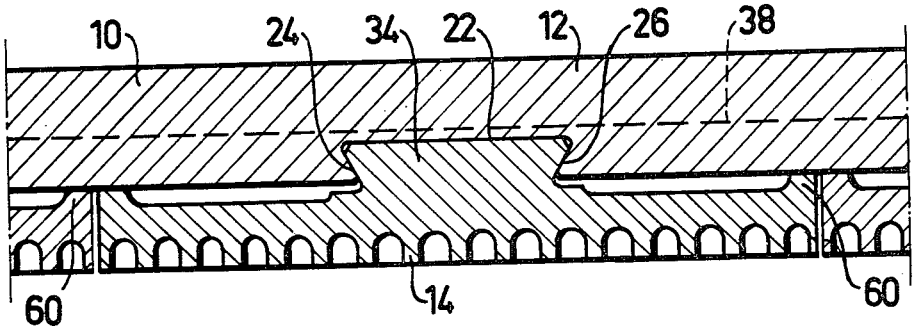
FIGS. 2 and 3 show detailed sections along the lines II—II and III—III in FIG. 1.
Figure 3:
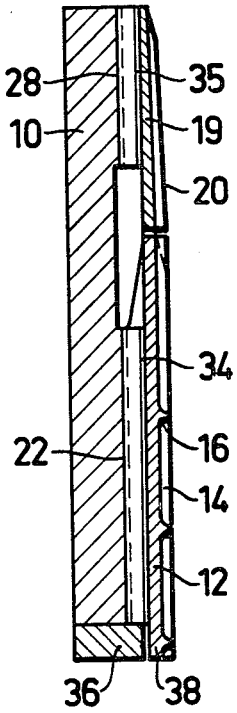

In the drawings the number 10 is used to denote an annular supporting disc to be mounted on a rotatable shaft in a defibrator or refiner for fibrous material, such as wood chips. This disc serves, in turn, as a support for the grinding plates which, in the version shown in FIGS. 1-3 are mounted in two concentric circles or rings. The plates are made of some extremely hard material such as nickel-chromium stainless steel. The grinding plates 12 forming the outer circle are provided with radial ribs 14 and transverse ridges 16 in the manner already familiar to the art, which together form the grinding surface for the material passing through the gap between the rotating disc and another disc of similar construction (not shown) working in conjunction with the first disc and either stationary or rotating in the opposite direction. The grinding plates 12 are mounted side by side with it, two sides 15 running parallel to the radius of the disc while the perforated edges 17, 18 defining their inner and outer perimeters describe circular arcs. In combination with the plates in the opposite grinding disc, the inner ring of plates 19 forms a feed zone and, as in known practice, is provided with fins or wings 20 for ejecting feed material from the centre to the grinding area or gap between the discs.

The supporting disc 10 is provided with fan-shaped or dovetail grooves 22, the walls 24, 26 of which diverge in the direction of the body of the disc. The edges 24, 26 of these grooves have a corresponding wedge shape, in that the width of the grooves 22 progressively narrows in a radial direction towards the centre. The proportions of this wedge or cone may be in the region of 1:20. Similar wedge-shaped grooves 28 having inclined dovetailed walls 30, 32 are provided in the supporting disc for the inner ring of plates 19. As is particularly apparent in FIG. 2, the back of each plate, that is the side opposite the ribbed surface 14, is provided with a tongue or projection 34, which is also fan-shaped or dovetailed to allow it to fit into a groove 22. Similarly, the tongues 34 are wedge-shaped and of the same size and proportion as their equivalent wedge-shaped grooves 22. The plates 19 are provided with wedge-shaped tongues 35 (FIG. 3) fitting into the grooves 28.

In the embodiment illustrated in FIGS. 1–3, the plates, 12 and 19 respectively, are mounted by introducing them into the wedge-shaped grooves, 22 and 28 respectively, from the outer circumference of the supporting disc, their tongues, 34 and 35 respectively, being forced or driven into position so as to achieve a rigid joint between plate and groove with no play between the two. In order to hold the grinding plates in position with even greater security, a ring 36 (FIG. 3) is mounted around the peripheral portion of grinding plates, which ring is secured to the supporting disc 10 by e.g. screw joints (not shown) and extending as far as an outer protrusion 38 on the plates. The latter are thereby radially secured even more firmly with a view to counteracting the effects of the centrifugal forces set up by the rotation of the grinding disc.

The invention therefore provides that the area between plate and supporting disc uniting the two comprises a large part, e.g. more than 50%, of the common surface, whereby operational stresses, arising chiefly as a result of centrifugal force, are distributed throughout the body of each plate instead of being concentrated to a few points only as was the case in the bolted joints used earlier. In spite of the fact that the plates are made of extremely hard material, in order to provide resistance to the heavy wear during the grinding operation, the plates can be made substantially thinner, and therefore lighter, than previously, due to the wedge-shaped joints, and this, too, is a contributing factor in further lessening the stresses arising specifically in the material of the plates. Since the tongues 34, 35 are fitted into the supporting disc, the tilting moment of the plates around the locking ring 36 under the action of centrifugal force is considerably reduced, for the centre of gravity of the plates is by this means moved closer in towards the surface of the supporting disc.

Figure 5:
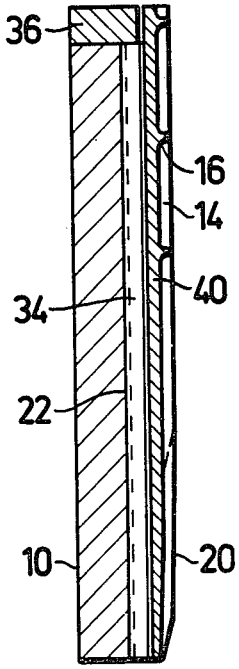
FIG. 5 shows a section along the line V—V in FIG. 4.

The embodiment illustrated in FIGS. 4 and 5 differs from that discussed above in that the disc 10 is provided with only a single ring of grinding plates 40 which extend radially across the entire width of the disc 10. Each plate thus comprises an outer section having raised ribs 14 and ridges 16, and an inner section provided with fins 20 for feeding the stock in towards the grinding area. In this version the cuneiform dovetail grooves 22 with their inclined walls 24, 26 extend radially across the entire supporting disc 10. As in the previous version, the distance between, the edges of the plates progressively lessens towards the centre and forms the shape of a wedge. Once the tongues 34 of the plates have been driven into the grooves, the inclined area of contact between the dovetailed walls 24, 26 will extend radially for practically the entire length of the plates.

Figure 6:
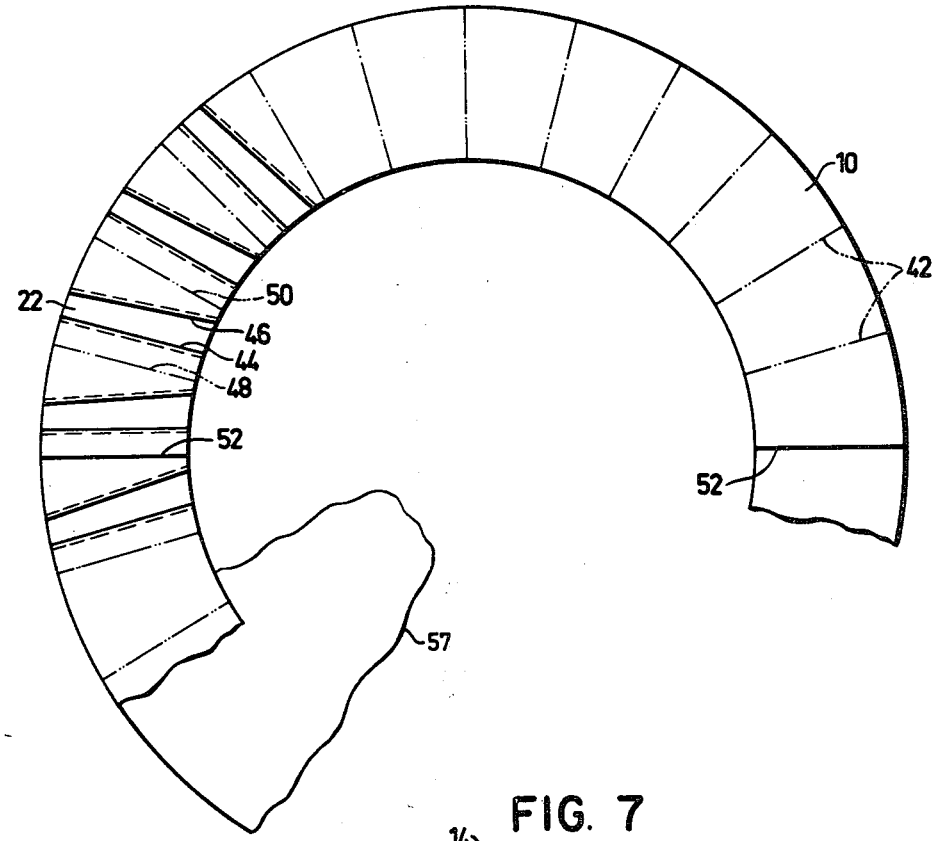
FIG. 6 shows a projection of part of a supporting disc upon which are mounted grinding plates designed in accordance with a further version of the invention.

In the embodiment illustrated in FIG. 6, the supporting disc 10, as in the version discussed above, is fitted with a ring of plates indicated in the drawing by the broken lines designated 42. These plates are introduced radially into the cuneiform dovetail grooves 22 of the supporting disc 10 from the inside, meaning that the mutual distance of the side walls 44, 46 of the grooves grows progressively less with increasing radial distance from the centre of the disc. In order to allow a plate to be driven home from the inside while retaining a movement parallel to the side of the plate with which it is in contact, one wall 44 of each groove runs parallel to one edge 48 of the plates themselves, the wedge or fan shape being defined by the direction of the opposite wall (50) of the groove in relation to the other edge 46 of the plates. Thus, each plate can be driven into position so that their sides will be parallel at their points of contact. This method can be used for all the plates except the final ring segment, which is fixed into position by constructing the disc 10 in more than one piece, here indicated by the numeral 52. These parts are carried on a supporting disc 57 in one piece mounted on the shaft.

In this version the plates are retained in position and are able to counteract the effects of centrifugal force thanks to the wedge shape of their dovetailed tongues, meaning that an outer locking ring 36 will not be necessary.

Figure 7:
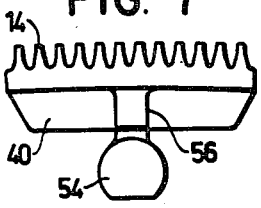
FIG. 7 shows an end view of a grinding plate designed in accordance with a further version of the invention.

Finally, the embodiment illustrated in FIG. 7 differs from the versions discussed previously in that the tongue 54 on the back of the plates 40 are round in section. These extend radially across the plates and their cross section grows progressively smaller, forming the shape of a cone towards one end, the direction of taper being dependent on whether the plates are designed to be introduced radially into the grooves provided in the disc 10 from the outside or the inside. The tongues are attached to the plates themselves by a narrow neck 56.

Clearly, the invention is not limited to the embodiments illustrated and discussed here but can be varied extremely widely within the framework of the underlying idea. Thus, it would be conceivable to provide the supporting disc with grooves running peripherally and of e.g. dovetail form, into which tongues of equivalent design may be introduced. Each plate may have more than one cuneiform tongue, these having a combined effect and running radially and peripherally at some distance from one another.

As is apparent in FIG. 1, the supporting disc 10 has an annular zone 58 without grooves 22, 28 which is of a depth and radial width sufficient to allow the inner ring of plates 19, each with its tongue 35, to be introduced radially into the wedge-shaped grooves 28 from the outside. The radial extent of the tongues 35 is thus slightly less than the width of this zone 58 of the ring. This is covered by those sections of the inner and outer rings of plates which face each other. The radial edges of the plates may be provided with ridges or shoulders 60 (FIGS. 1 and 2) bearing against the supporting disc and therefore conveying the pressure caused by grinding to the disc at this point.

I claim:

1. In a defibrating apparatus in which fibrous pulp material, such as wood chips, is ground in an interspace defined between two opposed relatively rotating discs (10) having a central opening for introducing the material into a central feed-in zone and supporting a plurality of arcuate grinding plate segments defined between two outwardly diverging radial side walls (48, 50) and disposed annularly about the rotating disc, said grinding plate segments having a frontal grinding surface comprising ribs (14) and ridges (16), and a rear surface for engaging said discs, the improvement providing relatively thin and relatively light segment plates comprising:

(a) dovetail-shaped grooves (22) in said discs (10) defined between diverging side walls (44,46) and extending with progressively decreasing width from an inner radial portion of said discs toward a radially outer portion thereof;

(b) tongues (34) projecting from the rear surface of said grinding plate segments for engaging said dovetail-shaped grooves (22);

(c) one of said diverging radial side walls (48, 50) each plate segment being parallel to one of said diverging side walls (44, 46) of said grooves, while the other one of said diverging radial side walls (48, 50) of each plate segment diverges in a radially outward direction relative to said grooves to permit insertion of said plate segments into said grooves from said central opening and thereby wedge said tongues (34) in dovetail fashion in said grooves during rotation of the disc.

2. A grinding disc according to claim 1, in which said disc is subdivided into sections (52), and said grooves (22) being arranged about the circumference of said sections to support said plate segments in the form of a circumference ring, said disc sections in turn being supported on a carrier disc (57).

* * * * *